US008555979B1

(12) United States Patent
Milanovich

(10) Patent No.: US 8,555,979 B1
(45) Date of Patent: Oct. 15, 2013

(54) BLOWOUT PREVENTER WITH A BERNOULLI EFFECT SUCK-DOWN VALVE

(71) Applicant: Philip John Milanovich, Phoenix, AZ (US)

(72) Inventor: Philip John Milanovich, Phoenix, AZ (US)

( * ) Notice: Subject to any disclaimer, the term of this patent is extended or adjusted under 35 U.S.C. 154(b) by 0 days.

(21) Appl. No.: 13/837,065

(22) Filed: Mar. 15, 2013

Related U.S. Application Data

(63) Continuation-in-part of application No. 13/533,964, filed on Jun. 26, 2012, now Pat. No. 8,418,767, which is a continuation-in-part of application No. 12/960,495, filed on Dec. 4, 2010, now Pat. No. 8,205,678.

(51) Int. Cl.
*E21B 43/01* (2006.01)

(52) U.S. Cl.
USPC ..... 166/354; 166/339; 166/343; 166/344; 166/367; 166/85.4; 405/158

(58) Field of Classification Search
USPC ..... 166/364, 338, 339, 341, 343–345, 351, 166/367–372, 381, 85.1, 85.4, 85.5; 405/52, 158
See application file for complete search history.

(56) References Cited

U.S. PATENT DOCUMENTS

| | | | | |
|---|---|---|---|---|
| 1,543,456 | A | 6/1925 | Stirling | |
| 3,980,138 | A | 9/1976 | Knopik | |
| 4,220,207 | A | 9/1980 | Allen | |
| 4,301,827 | A | 11/1981 | Murthy et al. | |
| 4,376,467 | A | 3/1983 | Allen | |
| 4,440,523 | A | 4/1984 | Milgram et al. | |
| 4,568,220 | A | 2/1986 | Hickey | |
| 4,605,069 | A | 8/1986 | McClaflin et al. | |
| 4,969,676 | A | 11/1990 | LaMagna | |
| 5,012,854 | A | 5/1991 | Bond | |
| 5,199,496 | A | 4/1993 | Redus et al. | |
| 6,026,904 | A | 2/2000 | Burd et al. | |
| 6,059,040 | A | 5/2000 | Levitan et al. | |
| 6,119,779 | A | 9/2000 | Gipson et al. | |
| 6,601,888 | B2 | 8/2003 | McIlwraith et al. | |
| 7,987,903 | B1 | 8/2011 | Prado Garcia | |
| 8,016,030 | B1 | 9/2011 | Prado Garcia | |
| 8,205,678 | B1 * | 6/2012 | Milanovich | 166/364 |
| 2010/0171331 | A1 | 7/2010 | Jonas et al. | |

* cited by examiner

*Primary Examiner* — Daniel P Stephenson
(74) *Attorney, Agent, or Firm* — Swift & Swift; Stephen Christopher Swift

(57) ABSTRACT

The present invention is a blowout preventer including a large funnel. The large end of the funnel is placed over a well pipe (or other pipe) through which oil (or other fluid) is blowing out. The small end of the funnel is connected to a return pipe. A high pressure pipe with a smaller diameter is inserted into the well pipe. Air is pumped under high pressure through the high pressure pipe, separating the oil and forcing the oil, that is not kept down in the well pipe by the pressure, up through the return pipe. The funnel can be moved into alignment with the well pipe using positioning arms. A stopper may be forced into the well pipe. There are propellers near an end of the high pressure pipe. There are stacked turbines in the return pipe. There is a gasket with pivoting overlapping plates, to seal the pipe.

20 Claims, 16 Drawing Sheets

BLOWOUT PREVENTER WITH A BERNOULLI EFFECT SUCK-DOWN VALVE

CROSS REFERENCE TO RELATED APPLICATION

This application is a Continuation-In-Part of Regular Utility patent application Ser. No. 13/533,964, filed on Jun. 26, 2012, which was a Continuation-In-Part of Regular Utility patent application Ser. No. 12/960,495, filed Dec. 4, 2010, issued as U.S. Pat. No. 8,205,678 on Jun. 26, 2012, which are both incorporated herein by reference.

BACKGROUND OF THE INVENTION

1. Field of the Invention

The present invention relates to apparatus and methods for preventing the escape of fluid from wells or pipes.

2. Description of the Prior Art

As shown by recent events in the Gulf of Mexico, oil well blowouts are a serious threat to the environment, and can be very costly. Current blowout preventers can be unreliable. While there are numerous prior inventions of blowout preventers, none are equivalent to the present invention.

U.S. Pat. No. 1,543,456 issued on Jun. 23, 1925, to Robert Stirling, discloses a blowout preventer, without the Bernoulli effect of the instant invention.

U.S. Pat. No. 3,980,138, issued on Sep. 14, 1976, to Duane L. Knopik, discloses an underground fluid recovery device, but does not disclose a funnel that is placed over a pipe from which fluid is escaping, as in the instant invention.

U.S. Pat. No. 4,220,207, issued on Sep. 2, 1980, to Neil W. Allen, discloses seafloor diverter, without the use of the Bernoulli effect, as in the instant invention.

U.S. Pat. No. 4,301,827, issued on Nov. 24, 1981, to Rajam R. Murthy and Billy J. Rice, discloses a guided-float accumulator suitable for use with a hydraulic system for an oil well blowout preventer, using reaction forces that oppose Bernoulli effect forces, rather than making use of Bernoulli effect forces as in the instant invention.

U.S. Pat. No. 4,376,467, issued on Mar. 15, 1983, to Neil W. Allen, discloses without the use of the Bernoulli effect, as in the instant invention.

U.S. Pat. No. 4,440,523, issued on Apr. 3, 1984, to Jerome H. Milgram and James Burgess, discloses a separating collector for subsea blowouts, but without air or other fluid being pumped down to create a Bernoulli effect, as in the instant invention.

U.S. Pat. No. 4,568,220, issued on Feb. 4, 1986, to John J. Hickey, discloses a system for capping and/or controlling undersea oil or gas well blowouts, but without the use of the Bernoulli effect, as in the instant invention.

U.S. Pat. No. 4,605,069, issued on Aug. 12, 1986, to McClafin et al., discloses a method for producing heavy, viscous crude oil, but it is not a blowout preventer, as is the instant invention.

U.S. Pat. No. 4,969,676, issued on Nov. 13, 1990, to Joseph L. LaMagna, discloses an air pressure pick-up tool using the Bernoulli effect, but it is not a blowout preventer, as is the instant invention.

U.S. Pat. No. 5,012,854, issued on May 7, 1991, to John A. Bond, discloses a pressure release valve for a subsea blowout preventer that is hydraulically operated, without making use of the Bernoulli effect as in the instant invention.

U.S. Pat. No. 5,199,496, issued on Apr. 6, 1993, to Clifford L. Redus and Peter L. Sigwardt, discloses a subsea pumping device incorporating a wellhead aspirator, using the Bernoulli effect, but does not disclose a funnel placed over a pipe from which fluid is escaping, as in the instant invention.

U.S. Pat. No. 6,026,904, issued on Feb. 22, 2000, to James A. Burd and Kenneth J. Huber, discloses a method and apparatus for commingling and producing fluids from multiple production reservoirs, but it is not a blowout preventer, as is the instant invention.

U.S. Pat. No. 6,059,040, issued on May 9, 2000, to Leonid L. Levitan, Vasily V. Salygin and Vladimir D. Yurchenko, discloses a method and apparatus for the withdrawal of liquid from wellbores, but unlike the instant invention, it is not a blowout preventer.

U.S. Pat. No. 6,119,779, issued on Sep. 19, 2000, to Larry Joe Gipson and Stephen Leon Carn, discloses a method and system for, separating and disposing of solids from produced fluids, but unlike the instant invention, it is not a blowout preventer.

U.S. Pat. No. 6,601,888, issued on Aug. 5, 2003, to Lon McIlwraith and Andrew Christie, discloses contactless handling of objects, using the Bernoulli effect, but unlike the instant invention, it is not a blowout preventer.

U.S. Pat. No. 7,987,903, issued on Aug. 2, 2011, to Jose Jorge Prado Garcia, discloses an apparatus and method for containing oil from a deep water oil well, but does not disclose the use of the Bernoulli effect, as in the instant invention.

U.S. Pat. No. 8,016,030, issued on Sep. 13, 2011, to Jose Jorge Prado Garcia, discloses an apparatus and method for containing oil from a deep water oil well, but does not disclose the use of the Bernoulli effect, as in the instant invention.

U.S. Patent Application Publication No. 2010/0171331, published on Jul. 8, 2010, discloses a Bernoulli gripper for holding two-dimensional components such as silicon-based wafers, but it is not a blowout preventer, as is the instant invention.

None of the above inventions and patents, taken either singly or in combination, is seen to describe the instant invention as claimed.

SUMMARY OF THE INVENTION

The present invention is a blowout preventer including a large frustoconical funnel or valve, made of metal or other suitable material. The large end of the funnel is placed over a well pipe (or other pipe) through which oil (or natural gas or other fluid) is blowing out. The small end of the funnel is connected to a return pipe. A high pressure (air separating) pipe with a smaller diameter is inserted into the well pipe. Air is pumped under high pressure through the high pressure pipe, separating the oil and forcing the oil that is not kept down in the well pipe by the pressure up through the return pipe. The funnel or valve is kept on the well pipe by positioning arms, turbines, propellers, and the Bernoulli effect, as well as pressure from the surrounding sea water. Sonar, or lights and cameras, may be used to locate the well pipe so that the funnel or valve can be attached to it. A first gasket at the top end of the channel prevents leaks. Channels and rotating turbines near the top of the funnel and rotating propeller blades on or near the end of the high pressure (air separating) pipe accelerate the flow, reducing pressure and increasing the suction due to the Bernoulli effect. The suction due to the Bernoulli effect, the rotating propeller blades and stacked turbines results in the sucking down of the funnel into the oil flowing from the pipe, as the increased velocity of the oil acts like the thrust of a ram jet, forcing the funnel down onto the well pipe. In underwater applications, the added pressure provided by the water to the outside of the funnel will also aid in the attachment of the funnel to the well pipe. At a depth of one mile below the surface of the sea, the water pressure is 2,300 to 2,500 pounds per square inch. The first Continuation-In-Part included the following additional features: 1. Jets by which the funnel may be moved into alignment with the well pipe. 2. Sensing devices on moveable arms. 3. A stopper that may be forced into the well pipe. 4. One-way valves in the stopper. 5. Stacked turbines in the return pipe. 6. A second gasket with pivoting overlapping plates.

This second Continuation-In-Part includes the following additional features: 1. Positioning arms by which the funnel and stopper may be moved into alignment with the well pipe. 2. Propellers at or near the end of the high pressure (air separating) pipe accelerate the flow of oil and increase the suck-down effect.

Accordingly, it is a principal object of the invention to prevent damage to the environment from oil well blowouts.

It is another object of the invention to prevent economic loss from oil well blowouts.

It is a further object of the invention to prevent damage to the environment from any kind of fluid escaping from a pipe.

Still another object of the invention is to prevent economic loss from any kind of fluid escaping from a pipe.

It is an object of the invention to provide improved elements and arrangements thereof in an apparatus for the purposes described which is relatively inexpensive, dependable and fully effective in accomplishing its intended purposes.

These and other objects of the present invention will become readily apparent upon further review of the following specification and drawings.

BRIEF DESCRIPTION OF THE DRAWINGS

Similar reference characters denote corresponding features consistently throughout the attached drawings.

DETAILED DESCRIPTION OF THE PREFERRED EMBODIMENTS

The present invention is a blowout preventer that may be used with oil or gas wells, under the sea or on land.

Figure 1:
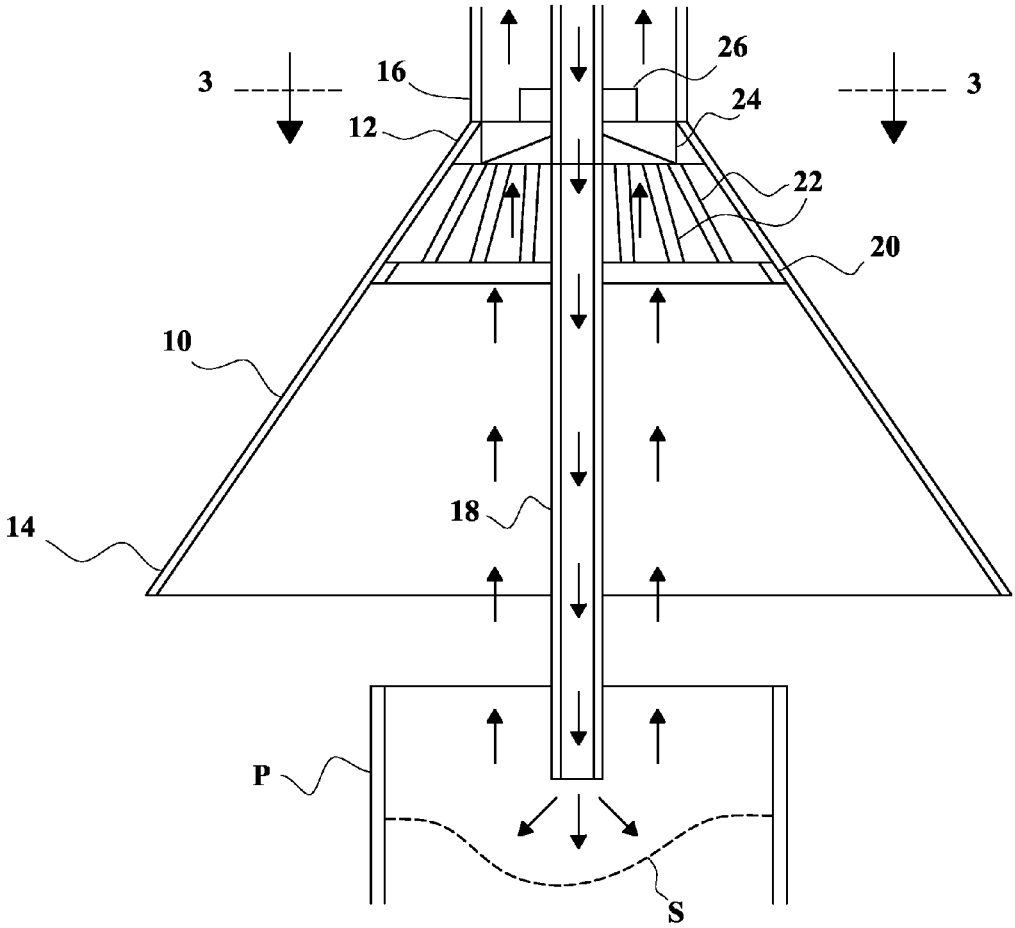
FIG. 1 is a vertical sectional view drawn along lines 1-1 of FIG. 3, showing the first preferred embodiment of the invention before the funnel is sucked down onto the pipe from which the first fluid is escaping.
Figure 3:
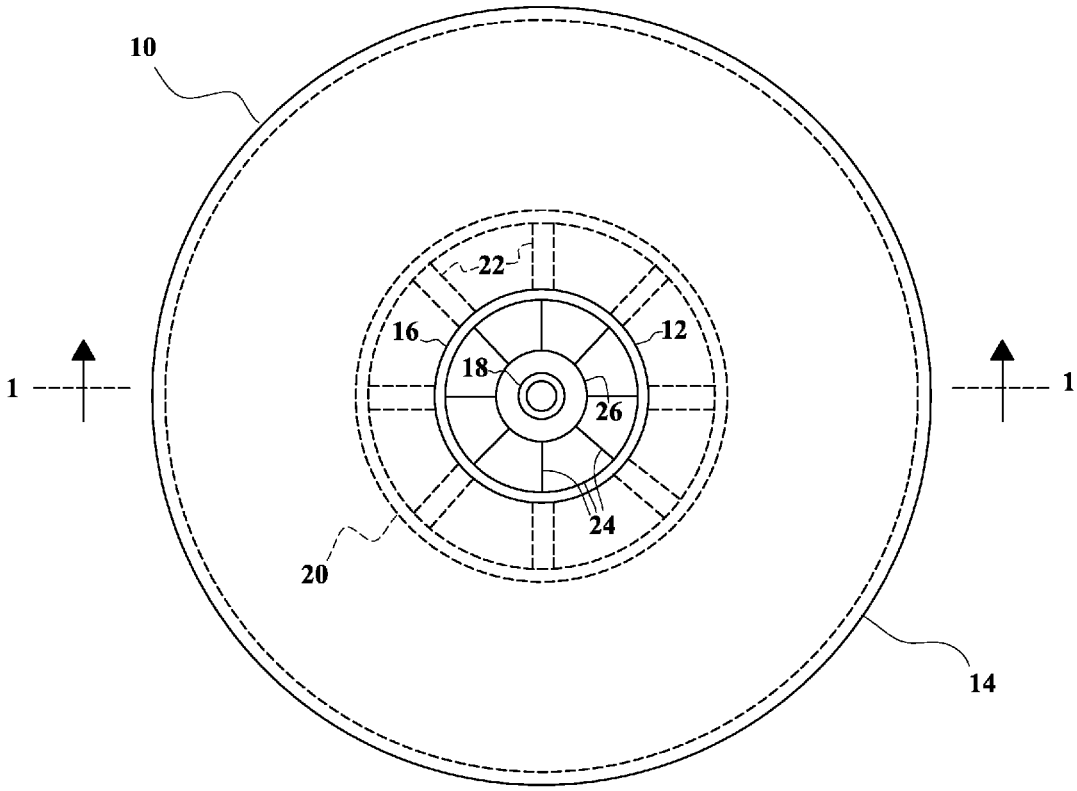
FIG. 3 is a horizontal sectional view drawn along lines 3-3 of FIG. 1, showing the first preferred embodiment of the invention.

The following are the features in the original patent application Ser. No. 12/960,495, filed on Dec. 4, 2010, now U.S. Pat. No. 8,205,678, issued on Jun. 26, 2012:

FIG. 1 is a vertical sectional view drawn along lines 1-1 of FIG. 3, showing the first preferred embodiment of the invention before the funnel 10 is sucked down onto the pipe P (which may be a well pipe or riser) from which a first fluid (such as petroleum) is escaping. The funnel has a hollow frustoconical shape, and has a smaller end 12 and a larger end 14 that is suitably dimensioned and configured to be placed over the pipe. A return pipe 16 is connected to the smaller end of the funnel. A high pressure pipe 18 passes through the return pipe and the funnel, and is suitably dimensioned and configured to be inserted into the pipe P. A second fluid (such as air) is pumped through the high pressure pipe at a pressure greater than that of the first fluid, causing the first fluid to be separated by the second fluid in a space S adjacent to an end of the high pressure pipe that has been inserted into the pipe through which the first fluid is escaping. A portion of the first fluid that is not held back by the greater pressure of the second fluid will flow through the funnel and the return pipe at an accelerated velocity, but at a reduced pressure due to the Bernoulli effect, thus helping to suck the funnel down onto the pipe P.

Figure 2:
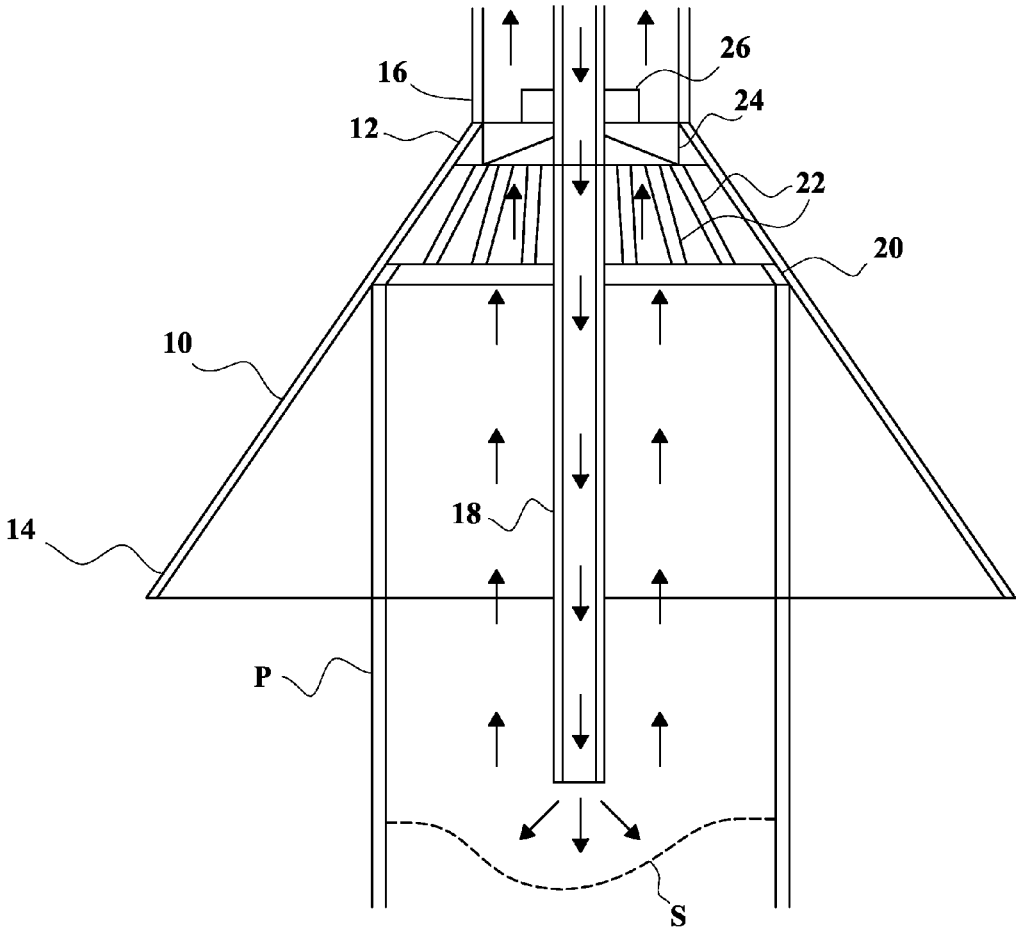
FIG. 2 is a vertical sectional view drawn along lines 1-1 of FIG. 3, showing the first preferred embodiment of the invention after the funnel is sucked down onto the pipe from which the first fluid was escaping.

FIG. 2 is a vertical sectional view drawn along lines 1-1 of FIG. 3, showing the first preferred embodiment of the invention after the funnel is sucked down onto the pipe P from which the first fluid was escaping. A first gasket 20 within the funnel prevents the first and second fluids from leaking out between the funnel and the pipe P. Inside the funnel, adjacent to its smaller end, there are channels to further accelerate the flow of the first and second fluids toward the return pipe. (The channels may be small pipes.) Adjacent to the smaller end of the funnel there is a turbine comprising blades 24 driven by motor 26, that can rotate to further accelerate the flow of the first and second fluids through the return pipe. FIG. 3 is a horizontal sectional view drawn along lines 3-3 of FIG. 1, showing the first preferred embodiment of the invention.

Figure 4:
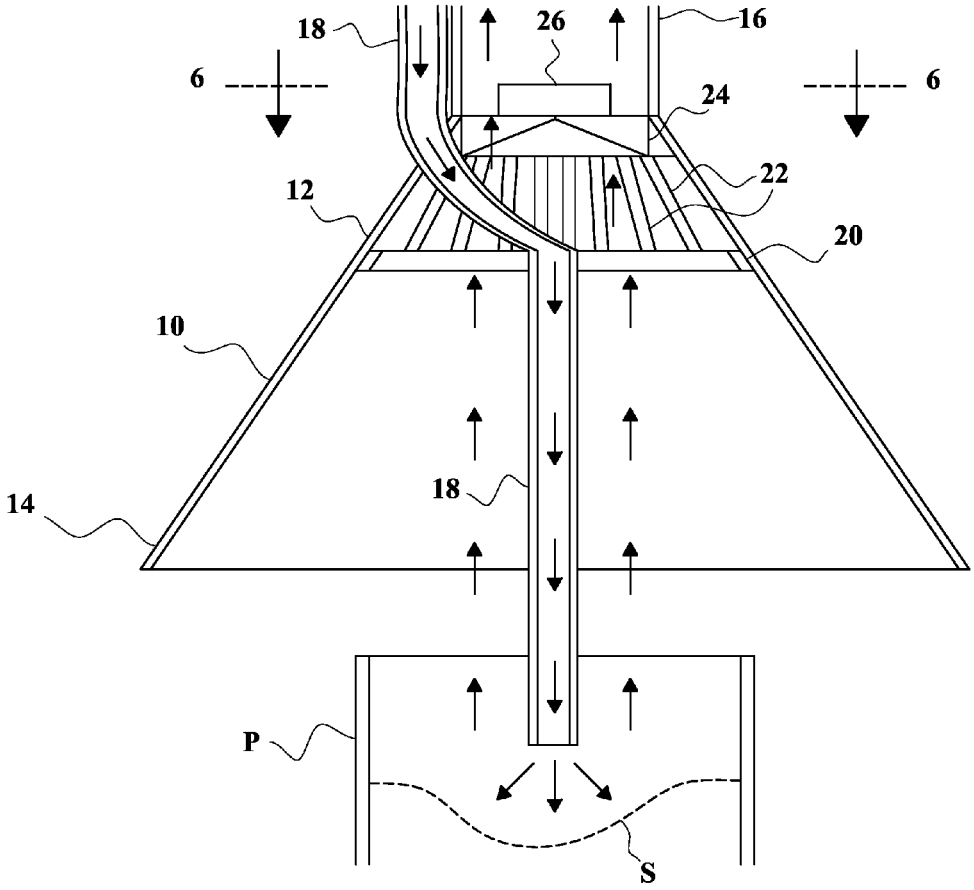
FIG. 4 is a vertical sectional view drawn along lines 4-4 of FIG. 6, showing the second preferred embodiment of the invention before the funnel is sucked down onto the pipe from which the first fluid is escaping.
Figure 5:
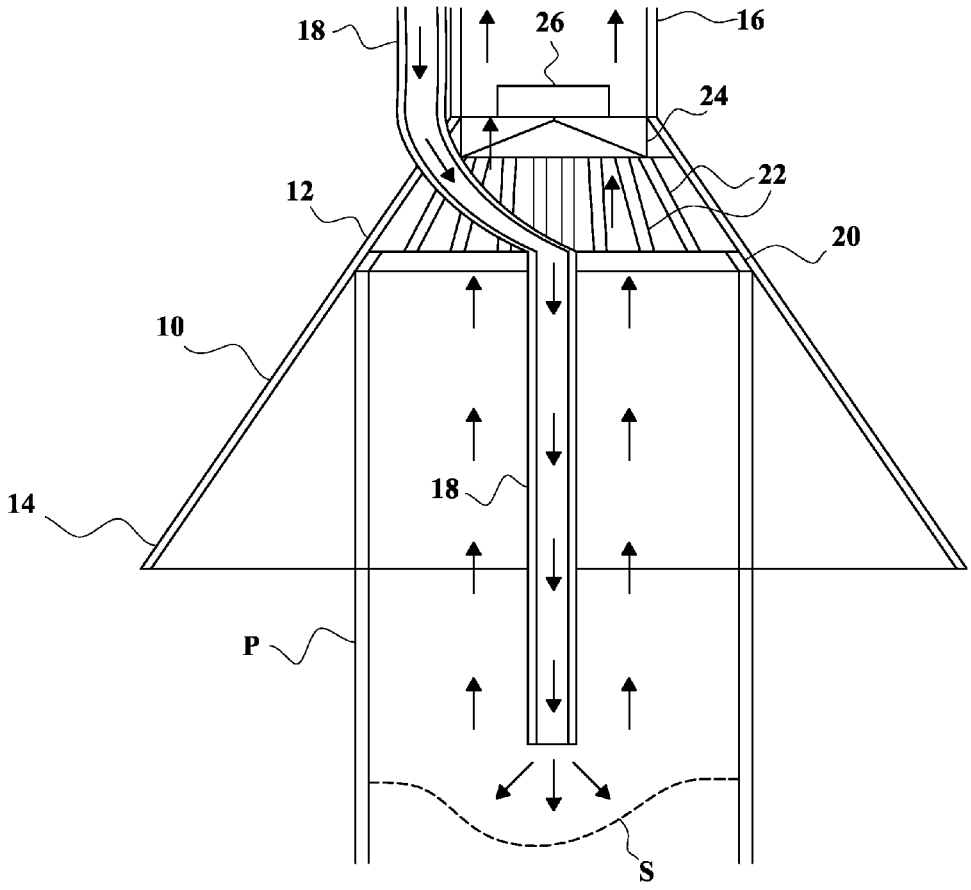
FIG. 5 is a vertical sectional view drawn along lines 4-4 of FIG. 6, showing the second preferred embodiment of the invention after the funnel is sucked down onto the pipe from which the first fluid was escaping.
Figure 6:
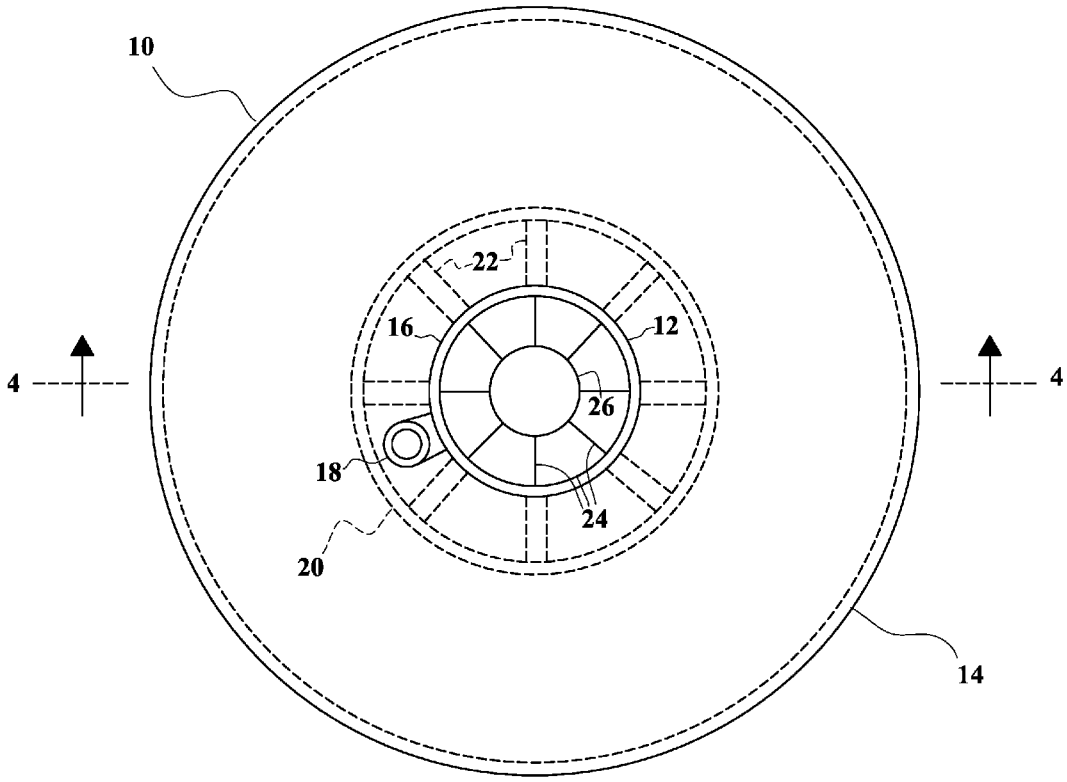
FIG. 6 is a horizontal sectional view drawn along lines 6-6 of FIG. 4, showing the second preferred embodiment of the invention.

FIG. 4 is a vertical sectional view drawn along lines 4-4 of FIG. 6, showing the second preferred embodiment of the invention before the funnel is sucked down onto the pipe from which the first fluid is escaping, which is the same as the first preferred embodiment, except that the high pressure pipe 18 is in an alternative position, passing outside the return pipe 16 and through a side of the funnel 10. FIG. 5 is a vertical sectional view drawn along lines 4-4 of FIG. 6, showing the second preferred embodiment of the invention after the funnel is sucked down onto the pipe from which the first fluid was escaping. FIG. 6 is a horizontal sectional view drawn along lines 6-6 of FIG. 4, showing the second preferred embodiment of the invention.

Figure 7:
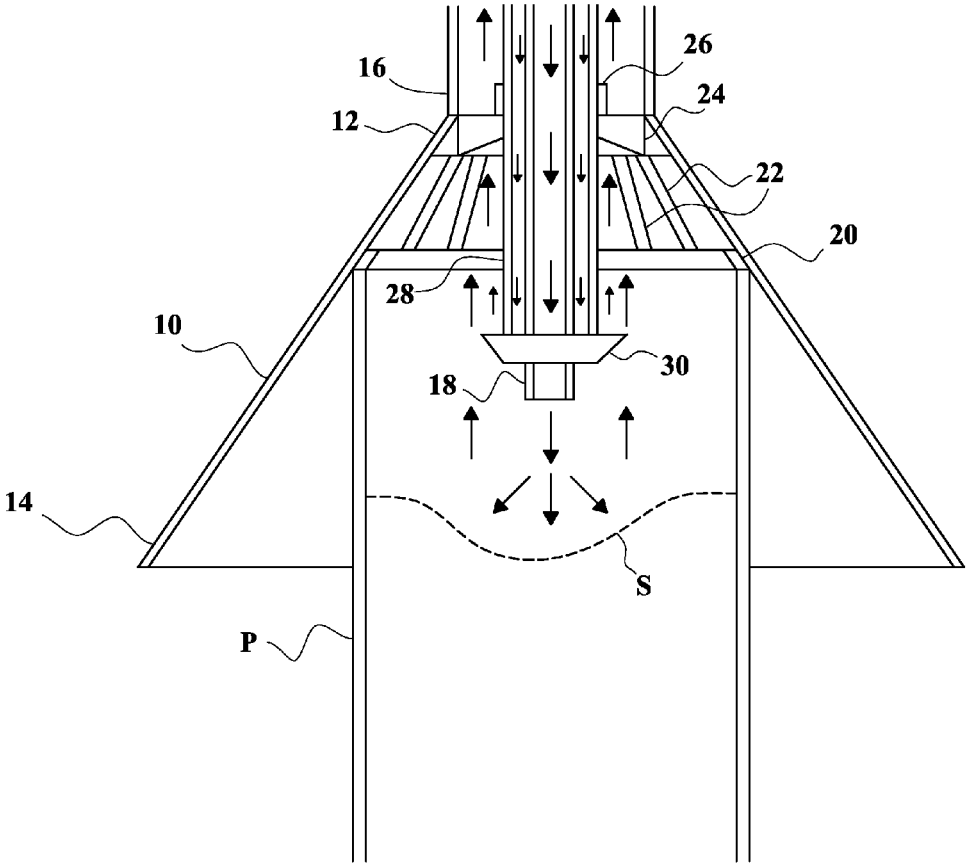
FIG. 7 is a vertical sectional view of the third preferred embodiment of the invention.

FIG. 7 is a vertical sectional view of the third preferred embodiment of the invention, in which there is a secondary air supply 28 with funnel 30, that can be used to keep the blades 24 turning. The high pressure pipe 18 is shown retracted back up into the funnel, which is also a means of keeping the blades turning.

Figure 8:
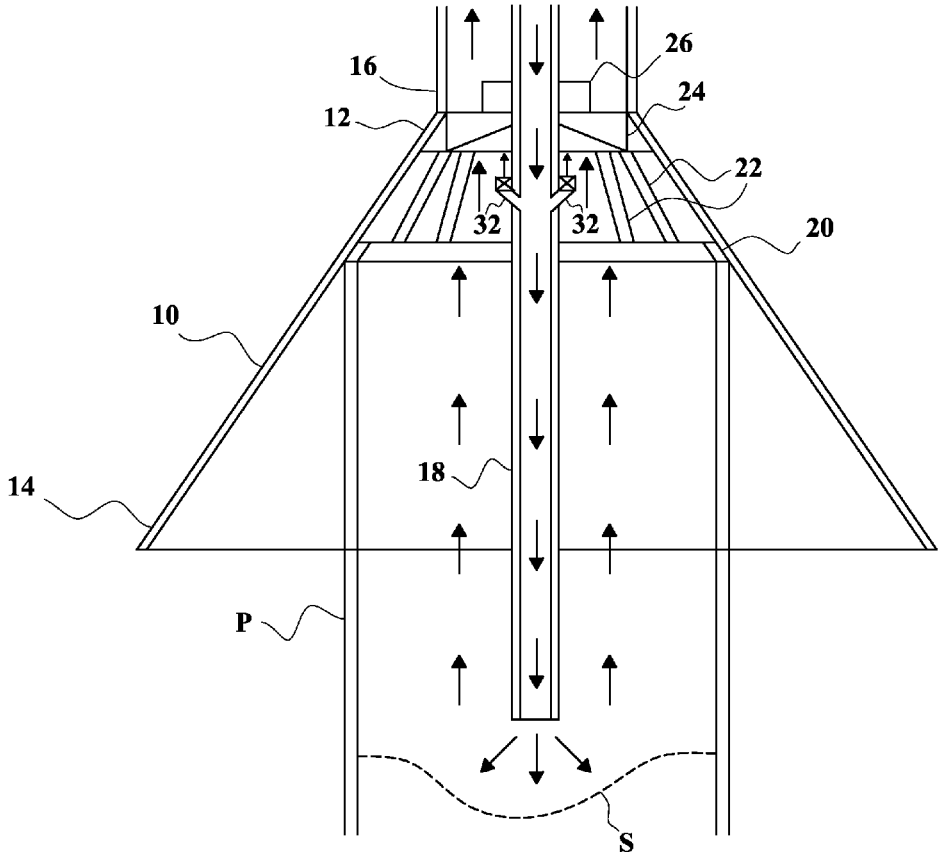
FIG. 8 is a vertical sectional view of the fourth preferred embodiment of the invention.

FIG. 8 is a vertical sectional view of the fourth preferred embodiment of the invention, in which there are valves 32 in the high pressure pipe 18 just below the blades 24 that can keep the blades turning. Note that the funnel can be sucked down both by pressure from the well, and by pressure from outside sources (that supply air to the high pressure pipe or a secondary air supply or electricity or fuel to the motor 26.)

The following were the new features in the first Continuation-In-Part, pending allowed application Ser. No. 13/533,964, filed on Jun. 26, 2012, which is a fifth preferred embodiment of the invention, shown in FIGS. 9-13:

1. Jets 34 (shown in FIGS. 9, 10 and 11) on an exterior surface of the funnel 10, through which a second fluid may be released to move the funnel into alignment with the pipe P through which the first fluid is escaping. The second fluid is supplied to the jets through a second high pressure pipe 36 with branches 37, and the jets each have a plurality of nozzles 38 that point in different directions. The second fluid will usually be air, and the air may be supplied through a compressed air pipe. (Alternatively, electric motors may be used to move the funnel.)

2. Sensing devices 40 selected from the group comprising lights and cameras, sonar, and global positioning system devices, on movable arms 42 (shown in FIGS. 9, 10 and 11) that can be extended from the funnel, by which the position of the funnel relative to the pipe through which the first fluid is escaping can be determined, so that it can be moved into alignment with said pipe using the jets (or motors). The arms may be moved between an extended position (shown in solid lines) and retracted position (shown in broken lines). The arms will generally be in an extended position when the sensing devices are used. There may be two arms, each moved by a motor 44, than can each rotate 180 degrees, giving 360 degree coverage of the surrounding area.

3. A stopper or plug 46 (shown in FIGS. 9 and 10) surrounding a portion of the high pressure pipe 18 inside the funnel, the stopper having an upper portion 48 with a diameter that is the same as the interior diameter of the pipe through which the first fluid is escaping, and a sloping lower portion 50, and a piston 52 that can push the stopper down into the pipe though which the first fluid is escaping. The lower portion must be smaller than the diameter of the pipe P, so that it can enter the pipe to a sufficient distance to close off the flow of the first fluid. The sloping or tapered shape of the lower portion may help in positioning the funnel and stopper onto pipe P, as well as helping to seal off the flow of the first fluid. The high pressure pipe must, of course, have a smaller diameter that the pipe through with the first fluid is escaping. The piston may be moved by an explosive charge, hydraulics, compressed air, electricity, springs, or any other suitable means. The stopper increases the Bernoulli effect by its shape and position in the funnel. One-way locks 54 may prevent the stopper from being destroyed by the flow of the first fluid and pressure.

4. One-way valves 56, (shown in FIGS. 9 and 10) through which the second fluid can be released through a portion of the high pressure pipe inside the funnel, to increase the Bernoulli effect, while preventing the first fluid from escaping. The one-way valves pass through the walls of the high pressure pipe and the stopper. The one-way valves allow the second fluid (e.g., air) to enter the pipe through which the first fluid (e.g., oil) is flowing, and stop the flow of the first fluid once the stopper is activated.

5. A plurality of turbines 57 (shown in FIGS. 9 and 10) in the return pipe 16 to accelerate the flow of the first fluid. The entire system, including the turbines, may be powered by air, electrical-wire, an electrical power pack, springs, or other suitable means. The turbines are stacked in the return pipe to increase suction.

6. A second gasket 58 (shown in FIGS. 9-11, and in detail in FIGS. 12 and 13) at the larger end of the funnel, the gasket having a circular rim 60 from which extend overlapping plates 62 pivotally attached to the rim, wherein the plates can be simultaneously rotated from an open position (shown in FIGS. 9 and 12), in which they do not block the funnel from being placed over the pipe from which the first fluid is escaping, to a closed position (shown in FIGS. 10 and 13), in which they contact said pipe and prevent the first fluid from escaping to the surrounding space. The gasket may be opened and closed by a draw string 64, a spring control spool powered by a battery pack, or any other suitable mechanism. The plates may be pivotally connected to the circular rim by springs or other suitable means.

Figure 14:
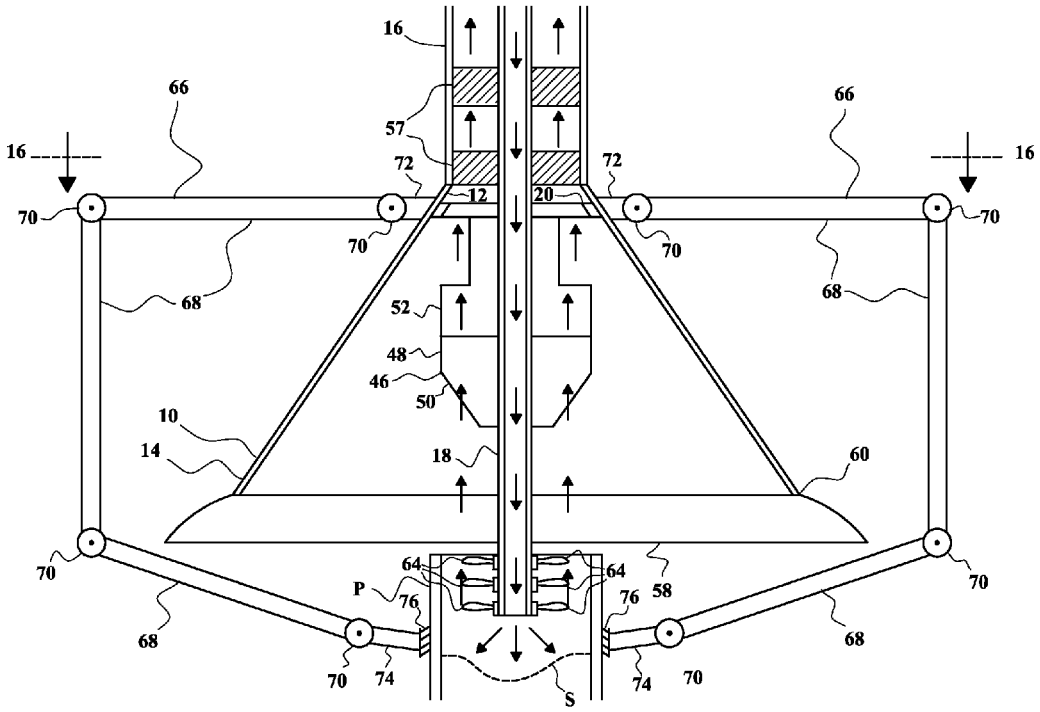
FIG. 14 is a vertical sectional view drawn along lines 14-14 of FIG. 16, showing the sixth preferred embodiment of the invention before the funnel is sucked down onto the pipe from which the first fluid is escaping.
Figure 15:
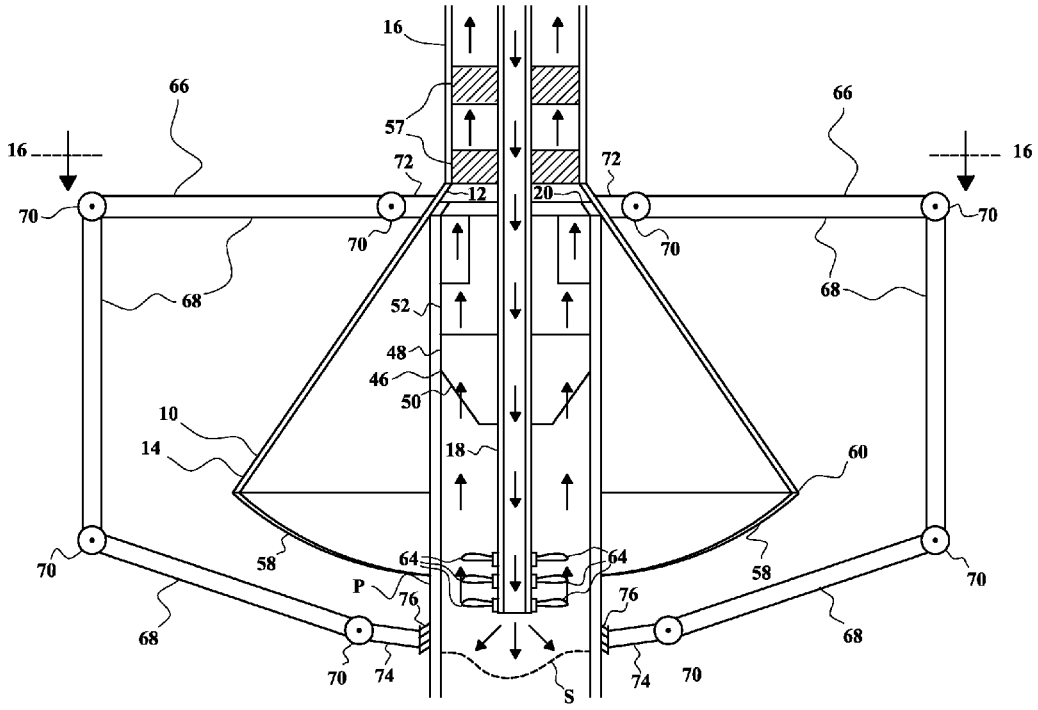
FIG. 15 is a vertical sectional view drawn along lines 14-14 of FIG. 16, showing the sixth preferred embodiment of the invention after the funnel is sucked down onto the pipe from which the first fluid was escaping.
Figure 16:
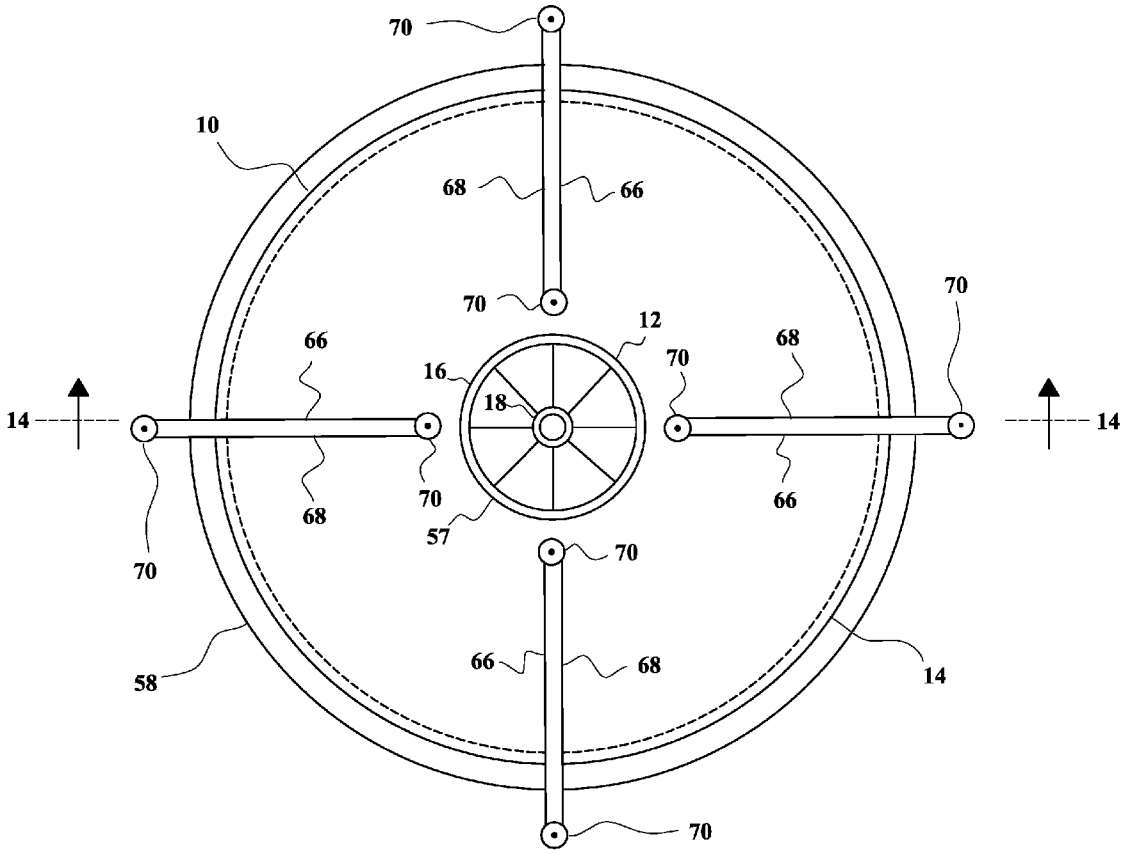
FIG. 16 is a horizontal sectional view drawn along lines 16-16 of FIG. 13, showing the sixth preferred embodiment of the invention.

The following are the new features in the present application, a second Continuation-In-Part, which is a sixth preferred embodiment of the invention, shown in FIGS. 14-16:

1. Positioning arms 66 extending from the funnel, said positioning arms being able to move the funnel into alignment with the pipe through which the first fluid is escaping, and then to hold it in place. The positioning arms each have a plurality of segments 68, and the segments are connected by motor driven joints 70 by which they can be moved. The positioning arms each have an inner segment 72 attached to the funnel. The positioning arms each have an outer segment 74 with a gripping surface 76. The tapering shape of the stopper may also aid the correct positioning of the funnel and stopper onto the pipe P by the positioning arms. Once they are in position, the second gasket 58 can be closed around pipe P, as shown in FIG. 15.

2. Propellers 64 on or near the end of the high pressure (air separating) pipe, that can rotate to accelerate flow of the first fluid into the turbines 57, giving the system a ram jet effect, that works in combination with the Bernoulli effect. The propellers may also help move the stopper into the pipe through which the first fluid is escaping, and help keep the stopper in place.

Figure 9:
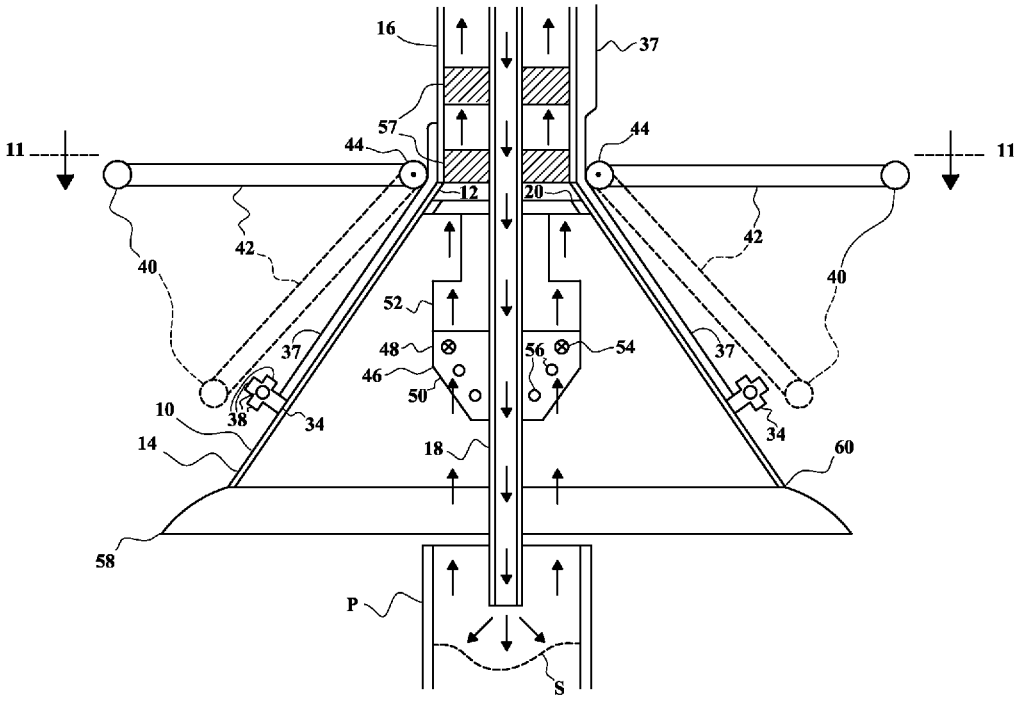
FIG. 9 is a vertical sectional view drawn along lines 9-9 of FIG. 3, showing the fifth preferred embodiment of the invention before the funnel is sucked down onto the pipe from which the first fluid is escaping.
Figure 10:
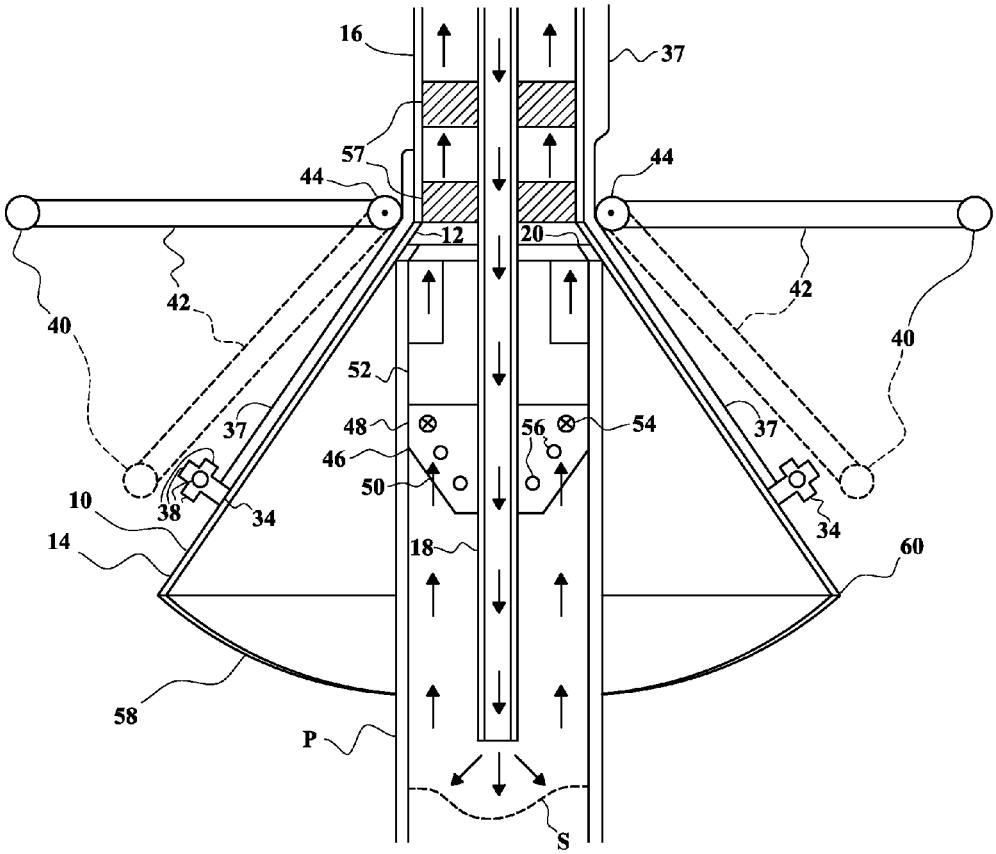
FIG. 10 is a vertical sectional view drawn along lines 9-9 of FIG. 3, showing the fifth preferred embodiment of the invention after the funnel is sucked down onto the pipe from which the first fluid was escaping.
Figure 11:
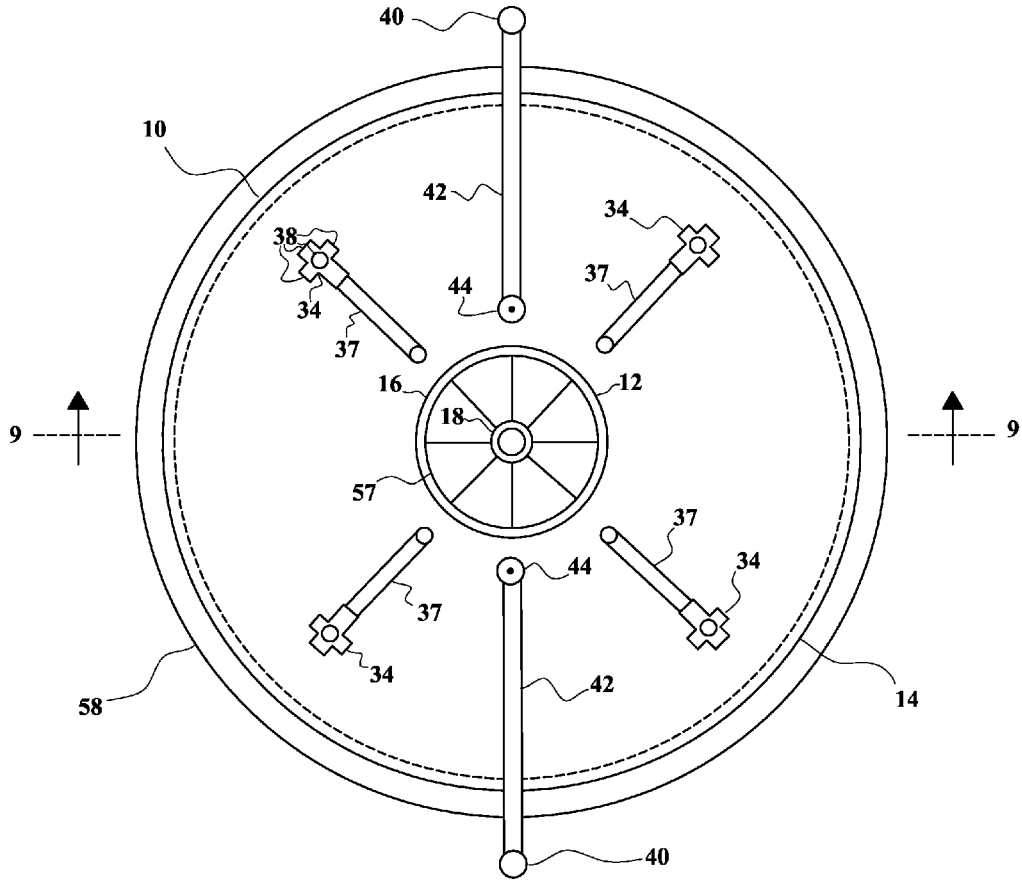
FIG. 11 is a horizontal sectional view drawn along lines 11-11 of FIG. 1, showing the fifth preferred embodiment of the invention.
Figure 12:
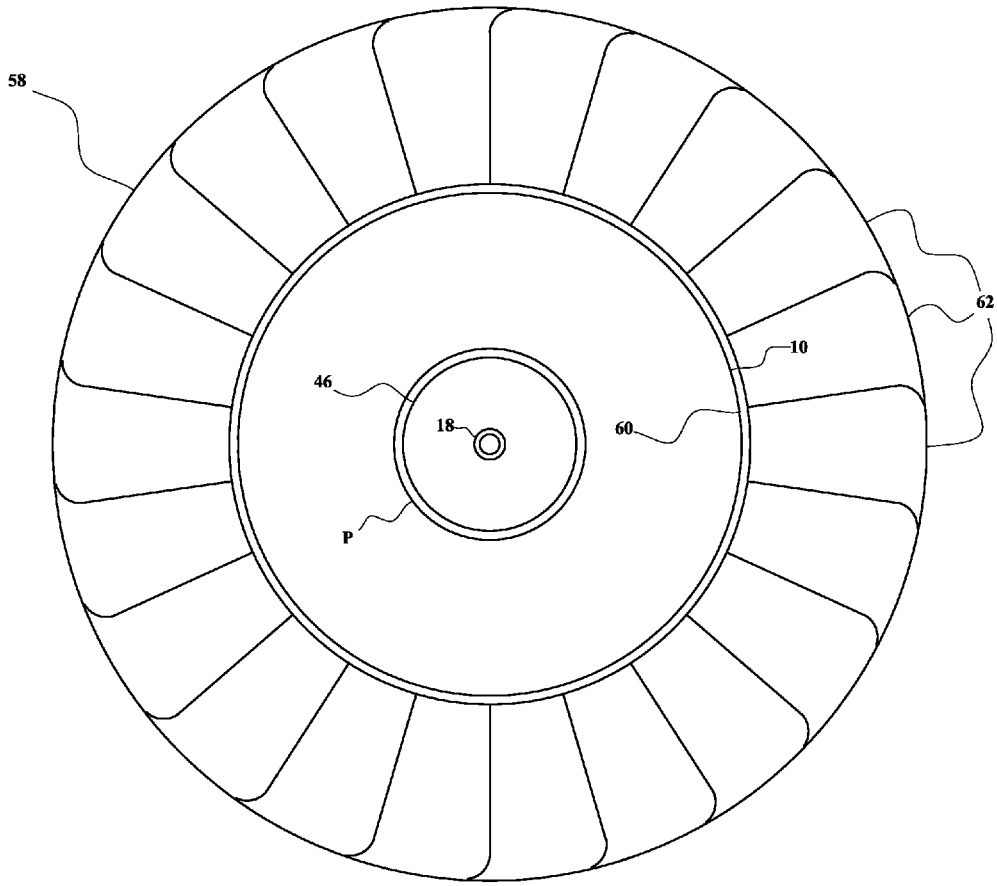
FIG. 12 is a detail view of the second gasket of the fifth preferred embodiment of the invention in an open position.
Figure 13:
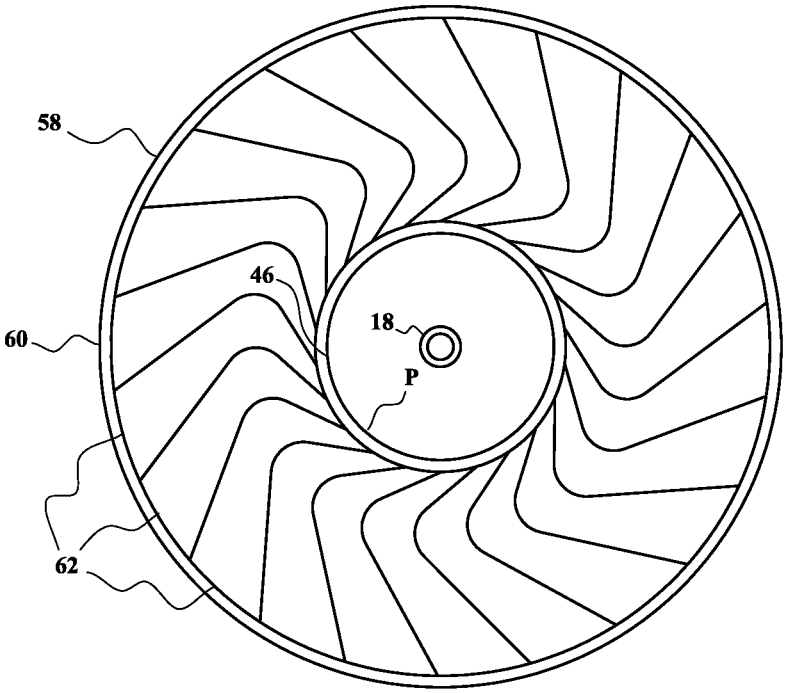
FIG. 13 is a detail view of the second gasket of the fifth preferred embodiment of the invention in a closed position.

3. Sensing devices (40 as shown in FIGS. 9, 10 and 11) selected from the group comprising lights and cameras, sonar, and global positioning system devices, can be attached to the positioning arms, by which the position of the funnel relative to the pipe through which the first fluid is escaping can be determined, so that it can be moved into alignment with said pipe.

The various parts of the invention may be made of either rigid or flexible materials.

It is to be understood that the present invention is not limited to the embodiments described above, but encompasses any and all embodiments within the scope of the following claims.

I claim:

1. A blowout preventer, comprising:

a funnel having a smaller end and a larger end, with the larger end being dimensioned and configured to be placed over an open end of a pipe through which a first fluid is escaping;

a return pipe connected to the smaller end of the funnel;

a high pressure pipe passing through the funnel, suitably dimensioned and configured to be insertable into the pipe through which the first fluid is escaping; and positioning arms extending from the funnel, said positioning arms being able to move the funnel into alignment with the pipe through which the first fluid is escaping;

wherein, when the second fluid is pumped through the high pressure pipe at a pressure greater than that of the first fluid, the first fluid will be separated by the second fluid in a space adjacent to an end of the high pressure pipe that has been inserted into the pipe through which the first fluid is escaping, and a portion of the first fluid that is not held back by the greater pressure of the second fluid will flow through the funnel and the return pipe at an accelerated velocity, but at a reduced pressure due to the Bernoulli effect, thus supplying suction to help move the funnel down onto the pipe from which the first fluid is escaping.

2. The blowout preventer according to claim 1, further comprising:

a stopper surrounding a portion of the high pressure pipe inside the funnel, the stopper having an upper portion with a diameter that is the same as the interior diameter of the pipe through which the first fluid is escaping, and a sloping lower portion; and a piston that can push the stopper down into the pipe though which the first fluid is escaping.

3. The blowout preventer according to claim 2, further comprising:

one or more propellers adjacent to an end of the high pressure pipe, that can rotate to accelerate flow of the first fluid, help move the stopper into the pipe through which the first fluid is escaping, and help keep the stopper in place.

4. The blowout preventer according to claim 1, wherein one or more of the positioning arms each have a plurality of segments, and the segments are connected by motor driven joints by which they can be moved.

5. The blowout preventer according to claim 4, wherein:

one or more of the positioning arms have an inner segment attached to the funnel; and one or more of the positioning arms have an outer segment with a gripping surface.

6. The blowout preventer according to claim 4, wherein devices selected from the group comprising lights and cameras, sonar, and global positioning system devices, are attached to the positioning arms, by which the position of the funnel relative to the pipe through which the first fluid is escaping can be determined, so that it can be moved into alignment with said pipe.

7. The blowout preventer according to claim 1, further comprising:

one-way valves, through which the second fluid can be released through a portion of the high pressure pipe inside the funnel, to increase the Bernoulli effect, while preventing the first fluid from escaping.

8. The blowout preventer according to claim 1, further comprising:

a plurality of turbines in the return pipe to accelerate the flow of the first fluid;

whereby the combination of the Bernoulli effect and the turbines acts like a ram jet.

9. The blowout preventer according to claim 1, further comprising:

a gasket at the larger end of the funnel, the gasket having a circular rim from which extend overlapping plates pivotally attached to the rim, wherein the plates can be simultaneously rotated from an open position, in which they do not block the funnel from being placed over the pipe from which the first fluid is escaping, to a closed position, in which they contact said pipe and prevent the first fluid from escaping to the surrounding space.

10. A blowout preventer, comprising:

a funnel having a smaller end and a larger end, with the larger end being dimensioned and configured to be placed over an open end of a pipe through which a first fluid is escaping;

a return pipe connected to the smaller end of the funnel;

a high pressure pipe passing outside the return pipe and through a side of the funnel, suitably dimensioned and configured to be insertable into the pipe through which the first fluid is escaping;

a stopper surrounding a portion of the high pressure pipe inside the funnel, the stopper having an upper portion with a diameter that is the same as the interior diameter of the pipe through which the first fluid is escaping, and a sloping lower portion; and a piston that can push the stopper down into the pipe though which the first fluid is escaping;

wherein, when the second fluid is pumped through the high pressure pipe at a pressure greater than that of the first fluid, the first fluid will be separated by the second fluid in a space adjacent to an end of the high pressure pipe that has been inserted into the pipe through which the first fluid is escaping, and a portion of the first fluid that is not held back by the greater pressure of the second fluid will flow through the funnel and the return pipe at an accelerated velocity, but at a reduced pressure due to the Bernoulli effect, thus supplying suction that helps to move the funnel down onto the pipe from which the first fluid is escaping, and then sealing it with the stopper.

11. The blowout preventer according to claim 10, further comprising:

one or more propellers adjacent to an end of the high pressure pipe, that can rotate to accelerate flow of the first fluid, help move the stopper into the pipe through which the first fluid is escaping, and help keep the stopper in place.

12. The blowout preventer according to claim 10, further comprising:

one-way valves, through which the second fluid can be released through a portion of the high pressure pipe inside the funnel, to increase the Bernoulli effect, while preventing the first fluid from escaping; and a plurality of turbines in the return pipe to accelerate the flow of the first fluid.

13. The blowout preventer according to claim 10, further comprising:

a gasket at the larger end of the funnel, the gasket having a circular rim from which extend overlapping plates pivotally attached to the rim, wherein the plates can be simultaneously rotated from an open position, in which they do not block the funnel from being placed over the pipe from which the first fluid is escaping, to a closed position, in which they contact said pipe and prevent the first fluid from escaping to the surrounding space.

14. A method of preventing blowouts, comprising the steps of:

placing a larger end of a funnel adjacent to an open end of a pipe through which a first fluid is escaping, the funnel having a smaller end that is connected to a return pipe;

moving the funnel into alignment with the pipe through which the first fluid is escaping using positioning arms extending from the funnel;

inserting a high pressure pipe into the pipe through which the first fluid is escaping;

pumping the second fluid, at a higher pressure than that of the first fluid, through the high pressure pipe into the pipe through which the first fluid is escaping;

separating the first fluid by the second fluid in a space adjacent to an end of the high pressure pipe that has been inserted into the pipe through which the first fluid is escaping; and accelerating a portion of the first fluid that is not held back by the greater pressure of the second fluid, causing it to flow through the funnel and the return pipe at an increased velocity, but at a reduced pressure due to the Bernoulli effect, thus supplying suction that helps to move the funnel down onto the pipe from which the first fluid is escaping.

15. The method of preventing blowouts according to claim 14 comprising the further step of:

pushing a stopper down into the pipe though which the first fluid is escaping, using a piston, said stopper surrounding a portion of the high pressure pipe inside the funnel, having an upper portion with a diameter that is the same as the interior diameter of said pipe, and a sloping lower portion.

16. The method of preventing blowouts according to claim 15 comprising the further step of:

accelerating flow of the first fluid by rotating one or more propellers within the stopper, helping to move the stopper into the pipe through which the first fluid is escaping, and helping to keep the stopper in place.

17. The method of preventing blowouts according to claim 15 comprising the further steps of:

engaging one-way locks to prevent the stopper from being dislodged; and increasing the Bernoulli effect by releasing the second fluid through one-way valves in a portion of the high pressure pipe inside the funnel, while preventing the first fluid from escaping.

18. The method of preventing blowouts according to claim 14 comprising the further step of:

determining the position of the funnel relative to the pipe through which the first fluid is escaping using devices selected from the group comprising lights and cameras, sonar, and global positioning system devices, on the positioning arms, so that the funnel can be moved into alignment with said pipe.

19. The method of preventing blowouts according to claim 14 comprising the further step of:

accelerating the flow of the first fluid using a plurality of turbines in the return pipe.

20. The method of preventing blowouts according to claim 14 comprising the further step of:

simultaneously rotating overlapping plates extending from a circular rim of a gasket at the larger end of the funnel, from an open position in which the plates do not block the funnel from being placed over the pipe from which the first fluid is escaping, to a closed position, in which they contact said pipe and prevent the first fluid from escaping to the surrounding space, and prevent any fluid from the surrounding from entering the return pipe.

* * * * *